United States Patent [19]

Aftalion

[11] 4,291,743

[45] Sep. 29, 1981

[54] METHOD AND APPARATUS FOR POURING MOLTEN METAL

[75] Inventor: Sebastian Aftalion, Glasgow, Scotland

[73] Assignee: British Steel Corporation, London, England

[21] Appl. No.: 134,962

[22] Filed: Mar. 28, 1980

Related U.S. Application Data

[63] Continuation of Ser. No. 941,664, Sep. 12, 1978, abandoned.

[30] Foreign Application Priority Data

Sep. 13, 1977 [GB] United Kingdom ..... 38174/77

[51] Int. Cl.[3] ..... B22D 11/10; B22D 23/00

[52] U.S. Cl. ..... 164/66.1; 164/415

[58] Field of Search ..... 164/66, 67, 82, 437, 164/438, 335, 133, 415; 222/590, 591, 603; 75/96; 266/207

[56] References Cited

U.S. PATENT DOCUMENTS

| | | | |
|---|---|---|---|
| 1,324,458 | 12/1919 | McIntosh | 164/66 X |
| 3,174,200 | 3/1965 | Keel et al. | 164/66 |
| 3,451,594 | 6/1969 | Stewart | 164/66 X |
| 3,908,734 | 9/1975 | Pollard | 164/66 |
| 3,921,704 | 11/1975 | Tozaki | 164/259 X |
| 4,102,386 | 7/1978 | Hildebrant et al. | 164/66 X |

FOREIGN PATENT DOCUMENTS

| | | |
|---|---|---|
| 2517834 | 4/1975 | Fed. Rep. of Germany . |
| 2611253 | 9/1977 | Fed. Rep. of Germany . |
| 2611831 | 9/1977 | Fed. Rep. of Germany . |
| 2655912 | 6/1978 | Fed. Rep. of Germany . |
| 1561165 | 2/1969 | France . |
| 7633849 | 12/1977 | France . |
| 7707636 | 2/1978 | France . |

OTHER PUBLICATIONS

"Vergiessen Von Stahl unter Stickstoff als Schutzgas" by Holzhausen, et al., Neue Hutte, vol. 2, No. 11, Nov. 1957, pp. 685–691.

"A New System for the Control and Protection of Casting Stream" by Maddever, et al., AME-ISS Open Hearth Proc., vol. 59, 1976, pp. 177–211.

*Primary Examiner*—Robert D. Baldwin
*Assistant Examiner*—K. Y. Lin
*Attorney, Agent, or Firm*—Bacon & Thomas

[57] ABSTRACT

A metal stream is protected from atmospheric contamination during casting by shrouding it with an inert gas from a gas source at the pour nozzle. The gas is supplied to a low turbulence zone at the nozzle which has a width at least one third of the length of the poured metal stream. The gas source may be an annulas surrounding the nozzle and having its inwardly and downwardly facing surfaces of perforated metal sheet and the outermost surfaces may be disposable in order to tolerate metal splashing. The need for a tube to enclose the protective gas is avoided.

18 Claims, 4 Drawing Figures

METHOD AND APPARATUS FOR POURING MOLTEN METAL

This is a continuation of application Ser. No. 941,664, filed Sept. 12, 1978, now abandoned.

This invention relates to pouring molten steel or other metals which are liable to atmospheric oxidation. The invention provides both a method and an apparatus suitable for use in pouring the metal to provide a protective gaseous shroud to limit the access of atmospheric oxygen (or nitrogen) to the falling metal stream and to the impact zone of the stream with the metal pool or receiving equipment beneath.

The invention is particularly suitable for use in the continuous casting of steel in order to protect the stream between the ladle and the tundish or between the tundish and the mould, especially when a sliding gate valve is used to control the steel flow. It is however useful in other applications where it is considered important to reduce re-oxidation during teeming, for example in the bottom casting of steels.

In a typical continuous casting plant for casting steel slabs, blooms or billets, the steel is poured through a nozzle in the bottom of a ladle in a stream into a steel pool in a tundish positioned directly under the ladle nozzle. The steel flows through one or more nozzles in the bottom of the tundish into the same number of open-ended copper moulds. The moulds are cooled to solidify the outer regions of the steel which is withdrawn from below each mould in a continuous strand. This is cut up into manageable lengths after complete solidification.

The desirability of protecting the steel from re-oxidation, and in some cases protecting it from reaction with nitrogen, during the continuous casting of certain grades of steel, in order to improve both the internal cleanness of the steel and the surface quality of the cast strand, has been recognised for some considerable time.

Tubular shrouds are successfully used in continuous slab casting, where the mould is relatively large, in the form of a long refractory nozzle extending from the tundish to the mould. The lower end of the nozzle is submerged below the surface of the steel in the mould. Such a shroud must be thoroughly preheated and insulated for at least half an hour before use. It is difficult to apply such a shroud between the ladle and the tundish because of the greater length which would be needed, because the shroud would interfere with oxygen lancing of the ladle nozzle at the start of casting and because of the difficulties that arise when a cast has to be aborted or sequence casting is to be carried out.

Shrouds in the form of hoods extending upwardly from the top of the tundish can be used in continuous casting plants in which it is possible to adjust the height of the ladle. In such plants casting can be begun with the ladle in the raised position so that its nozzle is freely accessible for lancing, and the ladle can then be lowered on to the top of the hood. However the tundish must be fitted with the hood before it is used.

A further type of shroud is described in U.S. Pat. No. 3,908,734 and consists of a tube which is positioned around the steel stream during casting. Inert gas is supplied to the tube through an inlet half-way along it. One difficulty in using this arrangement between ladle and tundish when the ladle is fitted with a sliding gate valve is that in such a case the steel stream is unlikely to be very smooth and so cannot be relied on not to splash over the tube and cause heavy skulling. This kind of shroud is more suited to the shorter distances between the tundish and the mould.

Liquid gas shrouds have also been used to protect the stream over the smaller distances between tundish and mould. Such a shroud is derived from liquefied gas jets fixed inside an annular supply tube surrounding the tundish outlet. Rather large amounts of liquefied gas are used. Such a system would be sensitive to severe steel splashing because of the limited number of jet openings.

Other attempts to solve the problem include the provision of a circular pipe surrounding the stream and provided with two slots and a large number of small orifices, so that an inert gas pumped into the pipe is blown out both upwardly and downwardly along the metal stream.

It has also more recently been suggested to protect the stream between the tundish and the mould with an inert gas emanating in a laminar flow from a porous ceramic distributor. This too would be very sensitive to splashing from a laterally moving ragged stream obtained with a sliding gate valve fitted to a ladle.

It would be desirable to provide a shrouding system which is versatile enough to be used with nozzles controlled by stopper rods or sliding gate valves which are apt to produce a ragged stream in a variable position, and to be used between ladle and tundish or between tundish and large or small mould, which can be positioned between ladle and tundish without the need to adjust the ladle height, and which requires only a short preparation time before it may be used. Furthermore, the system should be economical to install, maintain and operate.

According to the present invention there is provided apparatus for protecting a metal stream from the surrounding atmosphere when the metal stream is being poured from a nozzle into a receiver, comprising a source of inert gas adapted to provide a low turbulence zone of the inert gas surrounding the nozzle exit, the initial diameter of the zone at the gas source being at least one third of the length of the poured metal stream between the nozzle and the receiver. Preferably it is about half the length of the steam. The gas source is preferably adapted to provide the low turbulence zone not only around the nozzle exit but also extending downwardly around the metal stream and ideally for the whole length of the stream as far as the receiver.

In contrast to the prior art, in which inert gas shielding relies on a barrier of liquefied gas or a zone of turbulent gas which may be separated from the atmosphere by a solid barrier, a wide low turbulence gas zone is used. In this manner the penetration of atmospheric oxygen (or nitrogen) to the liquid metal surface can be effectively delayed. The term "low turbulence" refers to a gas flow regime having a Reynolds number between about 5000 and 50,000. It does not include gas flows which are laminar in the bulk of the gas, and which generally have a Reynolds number below about 2000.

The source of inert gas is preferably disposed symmetrically about the nozzle, and may with advantage extend substantially continuously about the nozzle. A suitable gas-dispensing element of the gas source is a perforated metal surface or surfaces, and the shape of the surface or surfaces may conveniently be flat, cylindrical, frusto-conical or part of a torus.

The gas source conveniently comprises an annular gas duct encircling the nozzle exit, preferably co-axially therewith. The duct may be of rectangular, trapezoidal, round or other cross-section, and preferably the inwardly and downwardly facing walls alone of the duct are perforated to allow a gas flow from within the duct.

Where the gas source provides gas both inwardly towards the metal stream and downwardly along the stream, it is preferred that the width of the zone of downwardly directed gas should be 1½ to 3 times the width of the zone of inwardly directed gas. The downwardly directed gas zone may accordingly be of a width about equal to the length of the metal stream.

Suitable perforated metal surfaces may be formed of perforated metal sheet, expanded metal sheet, wire mesh, parallel strip screen material or combinations of these materials. The metal may conveniently be steel.

The individual apertures in the metal surface are desirably at least thirty to one hundred times smaller in width than the width of the gas zone surrounding the nozzle exit. This inwardly directed gas zone may typically be between 600 and 1000 mm. in width in a continuous casting plant producing steel slabs. For practical applications, the width of the metal stream would be between 30 mm and 90 mm, which means that the width of the gas zone may be regarded as at least six times the width of the stream. The larger the principal apertures in the surface, the more suitably they are backed by a more finely apertured surface, for example refractory fibre paper and/or felt, to provide the low turbulence zone of gas. The refractory paper or felt may be present in several layers. The numbers and thicknesses of the different layers are selected to give a suitable gas flow rate from the surface having regard to the pressure of the gas supply.

The source of inert gas will be exposed near to the falling metal stream, and in some circumstances, for example in a steel stream pouring into a tundish from a nozzle controlled by a sliding gate valve, a considerable amount of metal splashing may be expected to result in a significant build-up of frozen metal over the gas source. After a period of time this will adversely affect the ability of the gas source to provide a low turbulence zone of gas around the nozzle exit. Accordingly, when using a perforated metal surface as a gas-dispensing element, the outermost surface may be a removable and expendable part which can be replaced by a similar but clean surface after a period of use. The expendable part may constitute only the outermost surface or surfaces, there being an inner surface or surfaces which are permanent parts of the gas source.

The gas source itself, in the form of an annular gas duct suitable for encircling the nozzle exit and adapted to provide a low turbulence zone of inert gas surrounding the nozzle exit when in position and provided with a suitable inert gas supply, is a distinct part of the present invention.

The gas source may be carried on a support member so as to be movable both vertically and laterally, thereby to facilitate positioning around the nozzle exit under a ladle, tundish or other molten metal container. The source may accordingly be fixed on a support arm slidably and rotatably mounted on a vertical shaft.

The invention also provides in a broad aspect a continuous casting plant for casting steel, in which steel is to be poured from a ladle to a tundish and thence to one or more continuous casting moulds, comprising apparatus as set out above for protecting one or more of the steel streams.

The invention further provides a method of protecting a metal stream from the surrounding atmosphere when the metal stream is being poured from a nozzle into a receiver comprising providing a low turbulence zone of inert gas surrounding the nozzle exit, the initial diameter of the zone being at least one third of the length of the poured metal stream between the nozzle and the receiver. This zone may be provided by apparatus as described above.

An inert gas which is probably suitable for all applications of the invention is argon. Another gas which may often be suitable is nitrogen, but it is known that this gas can react to give undesirable inclusions in certain grades of steel. In general the term inert gas covers any gas or mixture of gases which will not react adversely with the metal, or which reacts less adversely than the surrounding atmosphere (normally air).

A slow gas velocity is desirable, both for gas moving into the low turbulence zone and for the gas cloud constituting the zone itself. The object is essentially to supply fresh inert gas at a replacement rate, but preferably also to provide a flow of inert gas around the whole length of the metal stream. It is accordingly preferred that the linear velocity of the gas measured parallel to the metal stream near the nozzle should be less than about 1 m/sec. A suitable supply pressure might be 2 to 4 bar, but the supply will suitably be adjustable with regard both to both pressure and flow rate.

The invention further provides a method of continuously casting steel by pouring it in streams through nozzles from a ladle to a tundish and thence to one or more continuous casting moulds, in which one or more of the steel streams is protected from the surrounding atmosphere by the foregoing method.

One embodiment of the invention is illustrated by way of example in the accompanying drawings in which.

Figure 1:
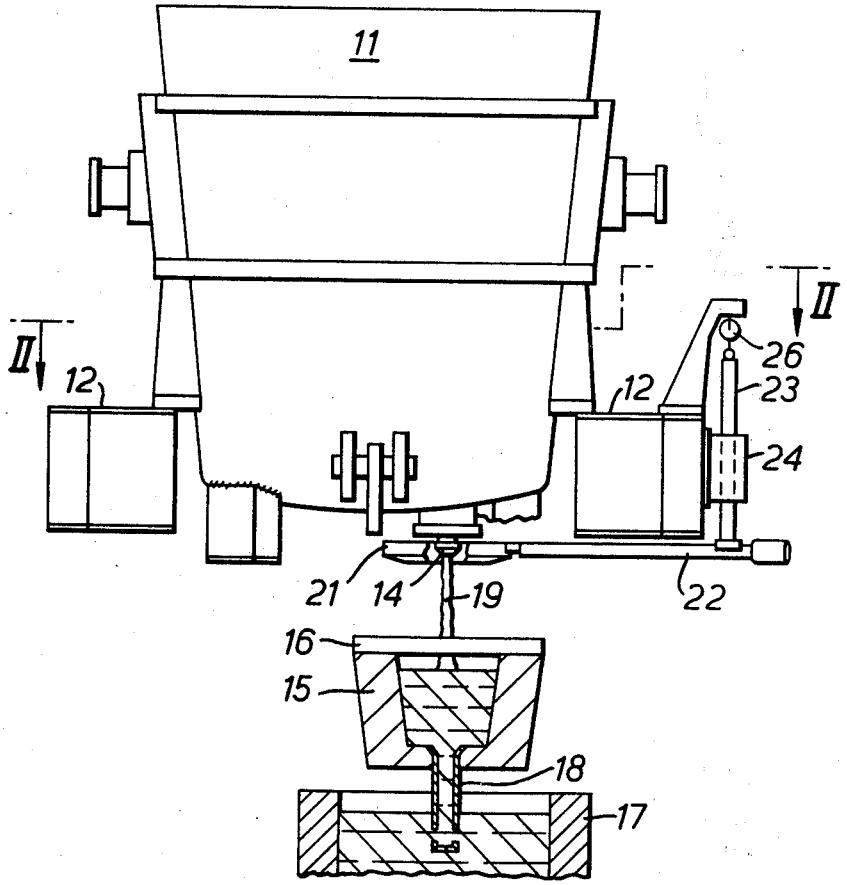
FIG. 1 is a general view of part of a plant for the continuous casting of steel showing a ladle and part of its support structure and an inert gas source (part broken away) in elevation, and a tundish and mould in section.
Figure 2:
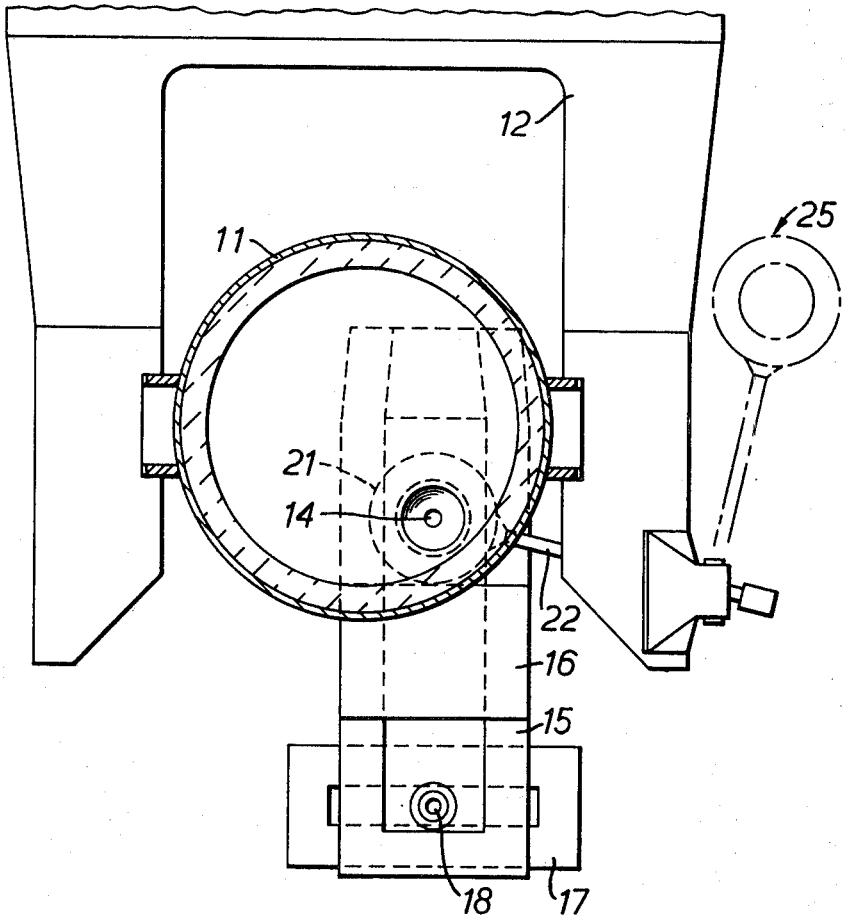
FIG. 2 shows the apparatus of FIG. 1 largely in plan, but the ladle in section taken along the line II—II in FIG. 1.

In FIGS. 1 and 2 a ladle 11 for carrying steel from the steelmaking plant is shown supporting on the two arms of a turret 12. The ladle is provided with a nozzle 14 which is controlled by a sliding gate valve. Directly beneath the nozzle is a tundish 15, partially covered by a lid 16, and below the tundish is a continuous casting mould 17. The steel stream between the tundish and the mould is in this instance protected by a submerged pouring tube 18 which is dependent from the tundish nozzle.

The steel stream 19 pouring from the ladle nozzle 14 to the tundish 15 is protected by argon which is supplied from a gas source in the form of a gas distributor ring 21. This is supported on a counterbalanced arm 22 which also functions as an argon supply pipe. The arm 22 is supported from a vertical shaft 23 which can rotate in a bearing sleeve 24 fixed to the side of the turret arm 12, so that the arm 22 can be rotated between its operative position under the ladle nozzle and a parked position shown in broken lines at 25 in FIG. 2. It can also be raised and lowered by raising or lowering the shaft 23 by means of a hoist 26.

This mounting system for the gas distrubutor ring 21 enables it to be swung horizontally from the parked position to the operative position under the ladle, where it can then be raised until it is surrounding the nozzle 14. It can be withdrawn by lowering it to clear the nozzle and then swinging it back to the parked position.

Figure 3:
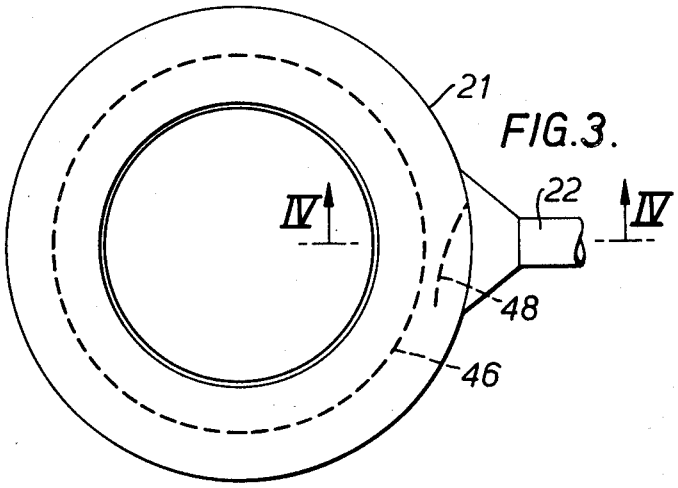
FIG. 3 shows in enlarged scale the inert gas source in plan.
Figure 4:
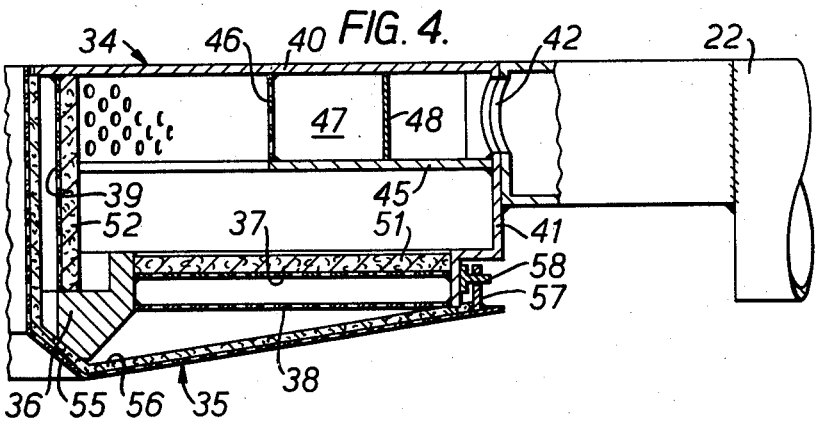
FIG. 4 is a section taken along the line IV—IV in FIG. 3, to a further enlarged scale.

The distributor ring 21 is shown in more detail in FIGS. 3 and 4. It is mounted on the end of the arm 22 through which the argon is supplied. It is made up of two readily separable parts. These are a main body portion 34 and a splash guard 35.

The body 34 is formed as an annulus of essentially rectangular cross-section. It is of welded construction and is formed from several steel sheets and a steel ring 36 at the junction of the lower and inner walls. The lower wall is formed from double sheets 37 and 38 and the inner face is formed from a single sheet 39, all of which plates are provided with a large number of perforations. The upper sheet 40 and the outer sheet 41 are solid except for a single large gas inlet port 42 in the latter communicating from the interior of the gas pipe formed by the arm 22.

The outer half of the upper half of the body 34, to which the port 42 communicates, is divided from the main chamber within the body by a solid floor sheet 45 and a perforated inner wall sheet 46 to form a primary inlet chamber 47 for the argon. This chamber contains a solid deflector plate 48 set obliquely across the inlet port 42.

The perforated sheets 37 and 39 forming the floor and inner wall respectively of the main chamber of the body 34 are lined on the inside with several layers of ceramic fibre paper 51 and 52.

The splash guard 35 consists of a further perforated steel sheet 55 lined with refractory fibre felt 56. It covers the inner and lower faces of the main body of the distributor ring formed by the perforated sheets 39 and 38. It is held in position by a slotted ring 57 welded to its outer rim which engages in a bayonet action with pins 58 on the outer steel plate 41 of the body 34.

When argon gas is supplied along the arm 22 it is deflected by the plate 48 to flow around the primary inlet chamber 47 at a relatively high speed. The gas flows into the main chamber through the perforated plate 46. From there it flows at a rate determined by the porosity and number of layers of ceramic fibre paper 51 and 52 through the perforated plates 37, 38 and 39 and then through the splash guard 35. The gas then provides a well distributed low turbulence flow around the steel stream pouring from the ladle nozzle 14. The perforated metal sheet 55 and the refractory fibre felt 56 making up the splash guard protect the main body of the distributor ring from the steel droplets which originate from the zone at which the steel stream meets the steel pool in the tundish. The splash guard can be replaced as it becomes necessary before an excessive number of the holes in the perforated sheet become plugged.

The dimensions of the distributor ring 21 and the distance from the ladle nozzle 14 to the surface of the metal pool in the tundish 15 are such that the inner diameter of the distributor ring is about half the length of the steel stream 19, while the overall diameter of the distributor ring is about equal to the stream length.

The embodiment of the invention shown in the drawings does not significantly interfere with visual inspection of and access to the nozzle 14. The normal requirement of oxygen lancing in order to start the steel flowing at the beginning of a cast can easily be performed by the operator. Solidified steel stalactites which form occasionally on the nozzle and cause spreading of the pouring stream can readily be observed and removed. It is possible to provide clearance between the gas distributor ring and the nozzle to reduce the likelihood of accidental damage due to deflection of the oxygen lance, and the splash guard 35 is capable of absorbing substantial impacts without significant damage.

The invention as described with reference to the drawings is suitable for use with a sliding gate valve in which the position of the steel stream moves as the nozzle centre travels between the open and closed positions. It is not essential that the stream should be in the exact centre of the distributor ring.

The ring can be positioned or removed within a short space of time and without any preheating requirement. It is thus possible to reserve a decision whether shrouding is to be used with a particular cast of steel until a late moment, for example until the steel analysis is definitely known, and no special preparation of the tundish is necessary.

It has been found that the use of the invention in the production of steel slabs by continuous casting as part of the process route to making surface-critical full finish aluminum killed cold rolled strip has enabled a yield of more than 90% to be achieved. Specific test and evaluation methods have shown that the number of relevant non-metallic inclusions in such steel slabs can be measurably reduced.

Additionally, extensive tests have been carried out on steel strip which was hot rolled. Coils rolled from steel slabs taken from six casts were tested. In two of the casts the invention was used experimentally, in the manner described above and illustrated in the drawings, and the remaining four casts were for comparative purposes and did not utilise the invention. In each case the coils rolled from the casts were sampled by cutting transversely to the rolling direction of the strip and examining the edges for linear discontinuities using the magnetic particle technique. The number of inclusions across the width of the strip in each sample were counted and the sample classified as follows:

Samples containing more than 10 indications—dirty—coded X.

Samples containing fewer than 10 indications—clean—coded O.

Samples which were completely clear—coded clean.

The following tables show the result of the tests.

| | Using Argon Shroud | | | | |
|---|---|---|---|---|---|
| | Number of coils | Total number of | Result | | |
| Cast | tested | samples taken | Clean | 0 | X |
| A | 7 | 19 | 5 | 14 | 0 |
| B | 8 | 14 | 10 | 4 | 0 |
| TOTAL | 15 | 33 | 15 | 18 | 0 |

| | Without Argon Shroud | | | | |
|---|---|---|---|---|---|
| | Number of coils | Total number of | Result | | |
| Cast | tested | samples taken | Clean | 0 | X |
| C | 6 | 11 | 0 | 2 | 9 |
| D | 7 | 13 | 1 | 7 | 5 |
| E | 6 | 11 | 2 | 9 | 0 |
| F | 8 | 14 | 2 | 10 | 2 |
| TO- | | | | | |

-continued

| | | | | | |
|---|---|---|---|---|---|
| TAL | 27 | 49 | 5 | 28 | 16 |

The effectiveness of the invention can be seen from these results.

We claim:

1. Apparatus for protecting an exposed metal stream from the surrounding atmosphere when the metal stream is being poured from a nozzle controlled by a stopper rod or a slide gate valve into a receiver, comprising means for providing inert gas, said means being in the form of a metallic walled distributor dimensioned and apertured to project said gas inwardly around the nozzle exit at such a rate as to provide a zone of the said gas surrounding the nozzle exit and moving downwardly around the stream, the width of the zone of gas inwardly directed around the nozzle exit being (a) at least one-third of the length of the poured metal stream between the nozzle exit and the receiver and (b) at least about 600 mm.

2. Apparatus as claimed in claim 1, wherein the width of the zone of gas inwardly directed around the nozzle exit is about one half of the length of the poured metal stream between the nozzle and the receiver.

3. Apparatus as claimed in claim 1 wherein the gas distributor is dimensioned and apertured to provide the zone of the inert gas extending from the nozzle exit downwardly around the metal stream for the whole length of the stream as far as the receiver.

4. Apparatus as claimed in claim 1 wherein the distributor is disposed symmetrically about the nozzle.

5. Apparatus as claimed in claim 4 wherein the distributor extends continuously about the nozzle.

6. Apparatus as claimed in claim 5 wherein the distributor comprises an annular gas duct encircling the nozzle exit co-axially therewith.

7. Apparatus as claimed in claim 6 wherein said annular gas duct is comprised of inwardly and downwardly facing walls apertured such that the gas is projected both inwardly and downwardly from within the duct.

8. Apparatus as claimed in claim 7 wherein the inwardly and downwardly facing walls are so constructed and arranged that the width of the zone of gas which issues from the downwardly facing walls is $1\frac{1}{2}$ to 3 times the width of the zone of gas which issues from the inwardly facing walls.

9. Apparatus as claimed in claim 1 wherein the apertures in the distributor are in the form of perforations.

10. Apparatus as claimed in claim 9 wherein the perforations are at least 30 to 100 times smaller than said initial width of the gas zone surrounding the nozzle exit.

11. Apparatus as claimed in claim 9 wherein the apertures in the perforated metal surface are backed by refractory fibre paper and/or felt in one or more layers.

12. Apparatus as claimed in claim 1 wherein the distributor is provided with an additional disposable protective outermost surface.

13. Apparatus as claimed in claim 12 wherein the additional outermost surface is of perforated metal.

14. Apparatus as claimed in claim 1 wherein the gas distributor is carried on a support arm mounted on a vertical shaft, about which the arm is rotatable in a horizontal arc, on which the arm can be raised or lowered.

15. Apparatus as claimed in claim 14 wherein the support arm comprises a pipe which supplies the inert gas to the distributor.

16. In a continuous casting plant for casting steel, in which steel is to be poured in a stream from a ladle to a tundish and thence in a stream to one or more continuous casting molds, the provision of apparatus for protecting an exposed metal stream from the surrounding atmosphere when the metal stream is being poured from a nozzle controlled by a stopper rod or a slide gate valve into a receiver, comprising means for providing inert gas, said means being in the form of a metallic walled distributor dimensioned and apertured to project said gas inwardly around the nozzle exit at such a rate as to provide a zone of the said gas surrounding the nozzle exit and moving downwardly around the stream, the width of the zone of gas inwardly directed around the nozzle exit being (a) at least one-third of the length of the poured metal stream between the nozzle exit and the receiver and (b) at least about 600 mm.

17. A method of protecting a metal stream from the surrounding atmosphere when the metal stream is being poured from the nozzle into a receiver, comprising positioning a source of inert gas having an annular gas duct to encircle the exit of the nozzle, said annular gas duct being so dimensioned and apertured to project an inert gas both inwardly and downwardly to provide a non-laminar, low turbulence zone of inert gas surrounding the nozzle exit and extending from the nozzle exit downwardly around the metal stream for the entire length of the stream as far as the receiver, said zone of inert gas possessing a flow regime having a Reynolds number between about 5,000 and 50,000.

18. A method as claimed in claim 17 wherein the linear velocity of the gas measured parallel to the metal stream near the nozzle is less than about 1 meter per second.

* * * * *